United States Patent [19]

Cenky

[11] Patent Number: 5,003,283

[45] Date of Patent: Mar. 26, 1991

[54] THERMAL CUTOFF WITH LEAD INDICIA

[75] Inventor: Mark A. Cenky, Lexington, Ohio

[73] Assignee: Therm-O-Disc, Incorporated, Mansfield, Ohio

[21] Appl. No.: 468,241

[22] Filed: Jan. 22, 1990

[51] Int. Cl.[5] ..... H01H 37/76

[52] U.S. Cl. ..... 337/403; 337/407

[58] Field of Search ..... 337/403, 404, 405, 406, 337/407, 408, 409; 264/40.1, 272.15, 268, 275, 274

[56] References Cited

U.S. PATENT DOCUMENTS 4,342,980 8/1982 Kovacs ..... 337/407

*Primary Examiner*—Harold Broome

*Attorney, Agent, or Firm*—Jones, Day, Reavis & Pogue

[57] ABSTRACT

A thermal cutoff of the type including an electrically conductive housing and an electrical lead having dielectric material sealingly interposed therebetween. Indicia is located on the lead such that when the dielectric material extends to or beyond the indicia, the distance between the housing and the lead along the dielectric material satisfies the minimum creepage distance required between two metal surfaces of opposite polarity.

20 Claims, 1 Drawing Sheet

THERMAL CUTOFF WITH LEAD INDICIA

BACKGROUND OF THE INVENTION

This application relates to the art of electrical components and, more particularly, to such components having two metal surfaces of opposite polarity separated from one another by a dielectric material. The invention is particularly applicable to thermal cutoffs of the type having an electrical lead separated from a conductive housing by a dielectric material, and will be described with specific reference thereto. However, it will be appreciated that the invention has broader aspects, and can be used with other electrical components having electrical leads.

A known type of thermal cutoff includes a conductive housing having an open end receiving a dielectric bushing through which an electrical lead extends. A curable dielectric sealing material is placed over the outer end of the bushing between the lead and housing. The distance between the housing and the lead along the outer surface of the dielectric material is supposed to satisfy the minimum creepage distance required between two metal surfaces of opposite polarity.

It would be desirable to have a simple and economical way of determining whether the minimum creepage distance requirement has been satisfied.

SUMMARY OF THE INVENTION

A thermal cutoff of the type described is provided with indicia located on the lead such that when the curable dielectric material extends to or beyond the indicia, the minimum creepage distance requirements are satisfied. This arrangement makes it possible to make a quick visual inspection of assembled thermal cutoffs to determine whether sufficient curable dielectric material has been provided to satisfy the minimum creepage distance requirement.

In a preferred arrangement, the indicia comprises serration means in the lead that not only provides a visual indication but also acts as a dam to prevent flow of the curable dielectric material along the lead.

The serration means preferably comprises a plurality of serrations spaced both axially and circumferentially of the lead tail.

The serrations preferably have straight serration bottoms that lie on the periphery of a straight sided geometric figure, such as a square.

The serrations extend into the lead tail from the outer surface thereof a distance between about 0.002–0.005 inch.

It is a principal object of the present invention to provide an improved lead for electrical components.

It is also an object of the invention to provide an electrical component having indicia on a lead for visually indicating whether a minimum creepage distance requirement has been satisfied.

It is an additional object of the invention to provide an improved thermal cutoff having a lead which minimizes flow of a curable dielectric material therealong.

DESCRIPTION OF A PREFERRED EMBODIMENT

Figure 1:
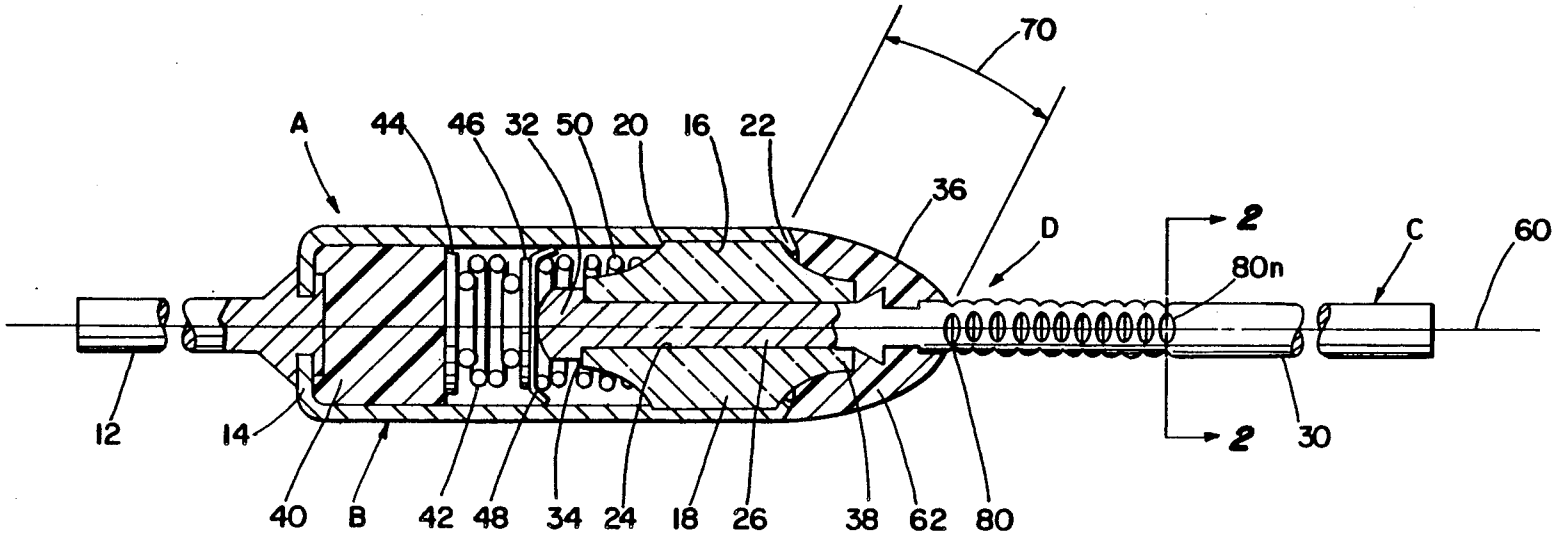
FIG. 1 is a partial cross-sectional side elevational view of a thermal cutoff having the improvements of the present application incorporated therein.

Referring now to the drawing, wherein the showings are for purposes of illustrating a preferred embodiment of the invention only and not for purposes of limiting same, FIG. 1 shows a thermal cutoff of the type including a generally cup-shaped electrically conductive metal housing B. An electrical lead 12 is directly attached to one end portion 14 of housing B. The open opposite end portion of housing B has a slightly enlarged internal diameter 16 receiving a dielectric bushing 18, and held therein against a shoulder 20 by an inwardly deformed terminal end portion 22 of housing B.

A central hole 24 through bushing 18 receives an inner mounting portion 26 of an electrical lead C having a outer lead tail 30. An enlargement 32 on an end portion of lead C within housing B defines an electrical contact located adjacent one end 34 of bushing 18. An outwardly deformed enlargement 36 on lead C adjacent opposite outer end 38 of bushing 18 prevents relative longitudinal movement between lead C and bushing 18.

A meltable thermal pellet 40 of dielectric material is positioned in housing B at end 14 thereof. A coil spring 42 acts against a washer 44 positioned against thermal pellet 40, and against a washer 46 engaging a sliding star contact 48 having a plurality of outwardly extending resilient fingers slidably engaging the interior of housing B. Another coil spring 50 acts between bushing 18 and star contact 48.

With the parts positioned as shown in FIG. 1, spring 42 is more powerful than spring 50 and biases star contact 4 into engagement with lead contact 32. This provides an electrically conductive path from lead 12 to lead C through housing B and star contact 48. In the event of a malfunction that raises the temperature of thermal cutoff A to its operating point, thermal pellet 40 melts. Washer 44 then moves toward housing end 14 and spring 42 elongates to substantially diminish its biasing force on star contact 48. The biasing force of spring 50 on star contact 48 then becomes substantially greater than the biasing force of spring 42 and causes star contact 48 to slide away from lead contact 32. This interrupts the conductive path between leads 12 and C.

When a thermal cutoff of the type described is manufactured, the thermal cutoff is positioned with lead C extending upwardly and thermal cutoff longitudinal axis 60 extending substantially vertically. One or more drops of a curable dielectric material 62, such as an epoxy, are placed over and around outer end 38 of bushing 18 in surrounding sealing relationship to lead C and housing B. The thermal cutoffs are then inverted so that lead 12 faces upwardly and thermal cutoff longitudinal axis 60 extends substantially vertically for curing dielectric material 62. In the curing position, dielectric material 62 tends to flow along lead C and, if too much flow occurs, the seal between such material and housing B, bushing 18 or lead C may be broken.

Housing B and lead C are of opposite polarity, and the distance 70 between housing B and lead C along the outer surface of dielectric material 62 must satisfy certain requirements. For example, one requirement is that distance 70 be at least three millimeters, and this is commonly referred to as the minimum creepage distance required between two metal surfaces of opposite polarity to prevent arcing. The outer surface of dielectric material 62 may become partly coated with dirt and/or moisture, and the minimum creepage distance requirement is intended to prevent arcing even under such circumstances.

In accordance with the present application, indicia is provided on lead tail 30 for indicating whether or not the minimum creepage distance requirement has been satisfied. the indicia is so located on lead tail 30 that when dielectric material 62 extends to or beyond such indicia, the minimum creepage distance requirement will be satisfied.

In one arrangement, the indicia may take the form of serration means generally indicated at D in FIG. 1 for providing the visual indication. The serration means also inhibits flow of a curable dielectric material 62 along lead C. In a preferred arrangement, serration means D comprises a plurality of circumferentially and axially-spaced serrations. In FIG. 1, only the beginning and ending axially-spaced serrations are indicated by reference numerals 80, **80*n*. As shown, there are a plurality of additional axial serrations that are axially-spaced apart equidistantly between beginning and ending axial serrations 80, 80*n*. First axial serration 80 is located on lead tail 30 relative to housing B such that distance 70 will satisfy the minimum creepage distance requirements when dielectric material 62 extends to or beyond serration 80**.

Figure 3:
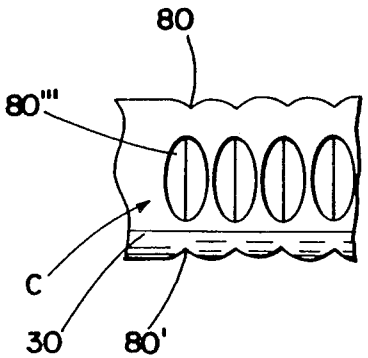
FIG. 3 is an enlarged side elevational view of a portion of an electrical lead having the improvements of the present application incorporated therein.
Figure 2:
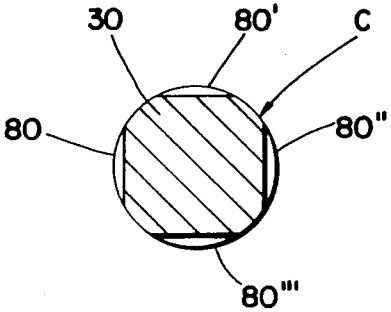
FIG. 2 is a cross-sectional elevational view taken generally on line 2—2 of FIG. 1.

As shown in FIGS. 2 and 3 for axial serration 80, each axially-spaced serration includes a plurality of circumferentially-spaced serrations 80, 80', 80''and 80''' that are circumferentially-spaced equidistantly around cylindrical lead tail 30. As shown in FIG. 2, each serration has a substantially flat bottom so it lies on the periphery of a straight sided geometric figure. In the arrangement shown, the straight bottoms of the serrations lie on the periphery of a square. The circumferentially-spaced serrations are preferably circumferentially-spaced from one another by an undeformed outer curved surface of lead tail 30. The serrations preferably occupy a substantially greater circumferential extent of the lead tail than the spacings between such serrations.

If the serrations are impressed too deeply into the lead, the lead may become brittle due to work hardening, and may be excessively weakened because of the reduction in its cross-sectional area. By way of example, where lead C has a diameter of about 0.04 inch, the serrations extend inwardly from the outer surface thereof about 0.002–0.005 inch. The axial serrations are spaced-apart from one another about 0.010–0.013 inch. As shown in FIG. 3 for serration 80, each serration is generally oval-shaped with its major axis extending laterally of the longitudinal axis of the lead.

Lead C is preferably made of copper or a copper alloy, and is plated with a precious metal or a precious metal alloy after the serrations have been formed therein. It would be undesirable to form the serrations after the lead had been plated with the precious metal because the coating may be interrupted or undesirably reduced in thickness in the area of the serrations.

The serrations provide dams to inhibit flow of the curable dielectric material therepast along the lead. If only one circumferential serration were formed in lead C, it would be difficult to pick out visually because of the small sizes involved. By providing a substantial number of axial serrations along a relatively long length of the lead, it is very easy to visually pick out the serrations and to tell where they stop. Thus, one may easily pick out the serrations visually and sight toward curable dielectric material 62 to determine whether such material is spaced a substantial distance from first serration 80. If the dielectric material appears to be covering a serration, it means that the minimum creepage distance requirement should be satisfied. However, if there appears to be a substantial space between first serration 80 and the beginning of dielectric material 62, it is a warning that the minimum creepage distance requirement may not be satisfied.

In the arrangement shown, there are 11 axially-spaced serrations and the distance between serrations 80, **80*n* is approximately 0.125 inch. Obviously, a larger or smaller number of axial serrations may be provided, and the length of the serrations may vary. The distance from first serration 80 to enlarged lead portion 32** that provides the inner contact is approximately 0.300 inch. Obviously, this dimension will vary depending upon the application and size of the thermal cutoff.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

I claim:

1. An electrical component including an electrically conductive end portion, an electrical lead having a lead tail extending outwardly from said end portion in adjacent spaced relationship thereto, dielectric material interposed between said end portion and said lead tail in sealing relationship therewith, and indicia on said lead tail outwardly of said end portion, said dielectric material extending along said lead at least to said indicia, the starting point of said indicia outwardly of said end portion being such that the distance along said dielectric material between said conductive end portion and said indicia is at least as great as the minimum creepage distance required between two conductors of opposite polarity, said lead tail being characterized by the absence of indicia thereon between said starting point of said indicia and said conductive end portion of said electrical component, and said indicia providing said lead tail with a localized discontinuity in shape in the location of the indicia for inhibiting flow of a curable dielectric material along said lead tail past said indicia.

2. The device of claim 1 wherein said indicia comprises at least one serration in said lead tail.

3. The device of claim 1 wherein said indicia comprises a plurality of serrations extending around said lead tail in circumferentially-spaced relationship to one another.

4. The device of claim 1 wherein said indicia comprises a plurality of axially-spaced serration in said lead tail axially-spaced from one another along the length of said lead tail.

5. The device of claim 4 wherein each said axially-spaced serration includes a plurality of circumferentially-spaced serrations spaced circumferentially from one another around said lead tail.

6. The device of claim 1 wherein said lead is a non-precious metal or alloy plated with a precious metal or alloy.

7. The device of claim 1 wherein said end portion is circular and said lead extends outwardly from said component centrally of said end portion.

8. The device of claim 1 wherein said component comprises a thermal cutoff through which current normally flows and having interrupting means for interrupting current flow therethrough in the event of circuit malfunction.

9. The device of claim 8 wherein said thermal cutoff includes an electrically conductive housing and said end portion is on said housing.

10. The device of claim 9 wherein said lead has a lead contact inside said housing.

11. The device of claim 1 wherein said lead tail has a cylindrical outer surface along the length thereof and said indicia comprises a serration extending inwardly of said outer surface at least about 0.002 inch.

12. The device of claim 11 wherein said serration extends inwardly of said outer surface not more than about 0.005 inch.

13. A thermal cutoff including an electrically conductive housing having an open end receiving a dielectric bushing, an electrical lead extending through said bushing and having an electrical contact thereon at one end of said bushing within said housing and having an elongated lead tail extending outwardly from the opposite end of said bushing, serration means on said lead tail outwardly from said opposite end of said bushing and from said housing open end for providing distance determining indicia, dielectric material sealingly interposed between said housing open end and said lead in covering relationship to said bushing opposite end, said dielectric material extending along said lead tail at least to the beginning of said serration means, the portion of said lead tail along with said dielectric material extends between said housing open end and the beginning of said serration means being characterized by the absence of serrations or other indicia and the minimum distance between said housing and the beginning of said serration means being at least as great as the minimum creepage distance required between two conductors of opposite polarity.

14. The device of claim 13 wherein said serration means comprises a plurality of axially-spaced serrations that are spaced axially from one another along the length of said lead tail.

15. The device of claim 14 wherein each said axially-spaced serration comprises a plurality of circumferentially-spaced serrations that are spaced circumferentially from one another around said lead tail.

16. The device of claim 15 wherein said circumferentially-spaced serrations have serration bottoms that lie on the periphery of a straight sided geometric figure.

17. The device of claim 13 wherein said serration means includes a plurality of circumferentially-spaced serrations that are spaced circumferentially from one another around said lead tail.

18. A thermal cutoff of the type including an electrically conductive housing and an electrical lead having dielectric material interposed therebetween, said lead having indicia thereon located such that when the dielectric material extends along a predetermined axial length of said lead from said housing at least to the indicia, the distance between said housing and lead along said dielectric material satisfies the minimum creepage distance required between two metal surfaces of opposite polarity, said lead along said predetermined axial length thereof covered by said dielectric material being characterized by the absence of indicia thereon.

19. An electrical component including an electrically conductive end portion, an electrical lead having a lead tail extending outwardly from said component in adjacent spaced relationship to said conductive end portion, dielectric material interposed between said end portion and said lead tail in sealing relationship therewith, and indicia on said lead tail outwardly of said end portion, said dielectric material extending along said lead at least to said indicia, the distance along said dielectric material between said conductive end portion and said indicia being at least as great as the minimum creepage distance required between two conductors of opposite polarity, said indicia comprising a plurality of circumferential serrations circumferentially-spaced equidistantly around said lead tail, said lead tail being cylindrical and said circumferential serrations having serration bottoms that lie on the periphery of a plane geometric figure having straight sides.

20. The device of claim 19 wherein said geometric figure is a square.

* * * * *